United States Patent [19]

Wittes et al.

[11] Patent Number: 4,557,825

[45] Date of Patent: Dec. 10, 1985

[54] BAG BREAKING AND SCREENING DEVICE, ESPECIALLY FOR BLAST CLEANING SYSTEMS

[75] Inventors: James M. Wittes, Linden, N.J.; Cecilia Sweeney, Yardley, Pa.

[73] Assignee: Empire Abrasive Equipment Corporation, Langhorne, Pa.

[21] Appl. No.: 634,259

[22] Filed: Jul. 25, 1984

[51] Int. Cl.[4] ..... B07B 1/00; B65B 3/16; B65B 1/04; B67B 7/24

[52] U.S. Cl. ..... 209/3; 209/254; 209/258; 209/259; 209/399; 414/292; 414/412; 222/88; 141/114; 141/330

[58] Field of Search ..... 209/3, 258, 259, 281, 209/352, 399, 405, 243, 254; 222/81, 88, 83.5, 86; 414/411, 412, 292; 141/330, 114, 286

[56] References Cited

U.S. PATENT DOCUMENTS

| | | | |
|---|---|---|---|
| 1,028,542 | 6/1912 | Christian | 141/330 |
| 1,073,825 | 9/1913 | Spring | 209/399 X |
| 2,002,611 | 5/1935 | Nall . | |
| 2,082,922 | 6/1937 | Vitek | 414/412 X |
| 2,107,995 | 2/1938 | Statham et al. . | |
| 2,306,426 | 12/1942 | Bundy . | |
| 2,316,195 | 4/1943 | Troxler | 209/3 |
| 2,644,430 | 7/1953 | Lang | 222/88 X |
| 2,720,698 | 10/1955 | Coffman, Jr. . | |
| 2,796,184 | 6/1957 | Wilkins et al. . | |
| 2,806,635 | 9/1957 | Kadal et al. | 222/88 |
| 3,145,858 | 8/1964 | Helbig . | |
| 3,171,449 | 3/1965 | Ellms et al. . | |
| 3,224,609 | 12/1965 | Dietert | 414/412 |
| 3,306,323 | 2/1967 | Aronson | 141/286 X |
| 4,307,990 | 12/1981 | Carlsson | 414/212 |

FOREIGN PATENT DOCUMENTS

| | | | |
|---|---|---|---|
| 543173 | 5/1956 | Italy | 414/292 |
| 906817 | 2/1982 | U.S.S.R. | 414/412 |

*Primary Examiner*—Frank W. Lutter
*Assistant Examiner*—Thomas M. Lithgow
*Attorney, Agent, or Firm*—Sperry, Zoda & Kane

[57] ABSTRACT

An upwardly pyramidal frame, formed of angularly spaced legs converging to a point, is mountable on a holder that extends about a fill opening of the pressure tank of a blast cleaning system. The frame is so disposed as to break open the end of a bag containing an abrasive media, when the bag is dropped onto the frame, with the break occurring at a location confined to the area of the fill opening. A screen supported upon a shoulder of the holder extends across the opening. At the bottom of the frame, outwardly directed feet on the legs extend into a space between the shoulder on which the screen is supported, and opposing, downwardly facing shoulders. Screws threaded in the feet bear against the peripheral portion of the screen, to clampably engage the feet and the screen against the opposed shoulders. When a screen is to be replaced, the screws are backed off, to loosen the frame and screen and permit their removal and replacement. Within the enclosure, a plunger head sealably closes the opening to maintain the tank in a pressurized condition. The screen is of inverted dished form to clear the plunger head.

9 Claims, 3 Drawing Figures

BAG BREAKING AND SCREENING DEVICE, ESPECIALLY FOR BLAST CLEANING SYSTEMS

BACKGROUND OF THE INVENTION

It has heretofore been proposed to provide upwardly tapering, generally conical or pyramidal bag breaking devices. However, so far as is known, none of these has been specially adapted for use on enclosures, such as the pressurized tanks of blast cleaning systems, where it becomes very important to facilitate the breaking of bags of particulate materials, and the emptying of the bags into the tank or other enclosure. In systems of the type referred to, an essential component is a pressurized tank, adapted to hold a quantity of abrasive media, such as glass beads, sand, or any of a wide variety of other particulates. With the materials in the tank, the tank is pressurized, so that the abrasive media can leave the tank in a stream of air under high pressure, and can be discharged with the carrier stream against a surface that is to be blast-cleaned.

Regular and continued operation of the system results in relatively swift emptying of the tank, as a result of which the practice is to depressurize the tank, manually break open a fresh bag of particulate material, up-end it over the fill opening of the tank, and after the bag is fully emptied re-pressurize the tank so that the system can again be placed into operation.

The time and effort required to manually open a bag, and thereafter physically lift it and up-end it without loss of the contents, into position above the fill opening, is obviously to be avoided if at all possible. The aim of the present invention is to provide an improved means, designed especially for fill openings of the character described, that will eliminate this time-consuming and laborious task.

SUMMARY OF THE INVENTION

Summarized briefly, the present invention utilizes, instead of the conventional O-ring holder that extends about the fill opening of a blast cleaning system pressure tank, a specially designed holder. This holder discharges the present function of the O-ring holder now in use. It also discharges the present, conventional function of supporting a screen in position extending across the fill opening.

Apart and distinct from these functions, however, in accordance with the present invention there is provided a holder that supports an upwardly pyramidal, open frame comprising a pair of inverted V-shaped bars crossing at right angles to each other, and having feet extending into a space defined by opposed shoulders formed upon the holder in close proximity to the groove in which the conventional O-ring is mounted. The screen has its peripheral portion supported upon one of the shoulders. The legs of the crossing bars have outwardly directed feet at their lower ends, and the legs are spring-tensioned to engage in the space between the opposed shoulders. Screws are threaded into the respective feet, and bear against the peripheral portion of the frame. When rotated in one direction, the screws spread the feet and the peripheral portion of the screen apart, so as to bind them tightly against the opposed shoulders. When turned in the other direction, the screws disengage the feet and screen, to permit ready removal of the frame and of the screen.

In accordance with the invention, the legs of the frame are formed as flat, wide bars, with the wide surfaces disposed in facing relation to the end of the bag dropped thereon. As a result, the weight of a closed bag of abrasive media, when the bag is dropped onto the pyramidal frame, causes the end of the bag to be torn open by the wide, flat surfaces. The tears in the bag are correspondingly wide, to facilitate the emptying of the bag contents into the tank through the fill opening, in a minimum amount of time. This decreases the amount of time that the tank is de-pressurized, and thereby renders the operation of the blast cleaning system more efficient, since down time resulting from the necessity of re-supplying the tank with abrasive media, is held to an absolute minimum.

BRIEF DESCRIPTION OF THE DRAWING

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
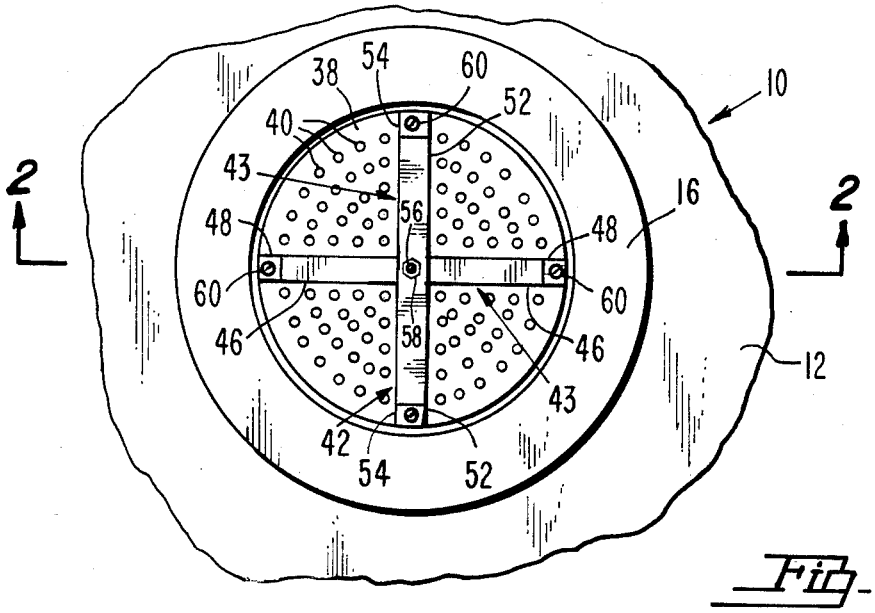
FIG. 1 is a fragmentary top plan view of a pressure tank of a blast cleaning system, showing in top plan a bag opening frame and screen assembly mounted on the tank in accordance with the present invention.

Referring to the drawings in detail, the reference numeral 10 generally designates an enclosure which in the present instance is the pressure tank of a blast-cleaning system. As will be noted, however, the invention can be applied to other structures with equal facility, and is adapted to be used wherever it is necessary to facilitate the breaking of a bag and the emptying of particulate materials from the bag through a fill opening into a hopper or other container. The invention, though having general application to the opening of bags containing materials of this type has, nevertheless, a specific and particular adaptation for employment in blast-cleaning systems. This is so because systems of this type require tanks that are maintained under pressure, in a manner such as to cause abrasive media to be discharged from the tanks under high pressure into blast-cleaning hoses or the like, for discharge against a surface that is to be cleaned or otherwise conditioned by the airborne, pressurized stream.

In the present invention, the tank includes a top wall 12, having a fill opening 14 bounded by a continuous, angular holder welded as at 17 within the opening 14.

The holder is formed with a continuous, inwardly facing O-ring groove 18, in which is engaged a resilient O-ring of rubber or other suitable sealing material.

Within the tank, there is provided a plunger head of upwardly bulging form, of upper surface of which is provided with a protective layer of rubber or the like. The plunger head 22 is adapted to be forced against the O-ring 20 whenever the tank is pressurized. To this end, the plunger head includes a tubular, downwardly opening stem 26, slidably, loosely positioned upon an upwardly projecting plunger support tube 28 fixedly secured at its lower end to an elbow 30, which in turn is secured fixedly to a horizontally directed air inlet tube 32. The inlet tube extends out of the tank, where it is connectable to a source of air under pressure, not shown.

Figure 2:
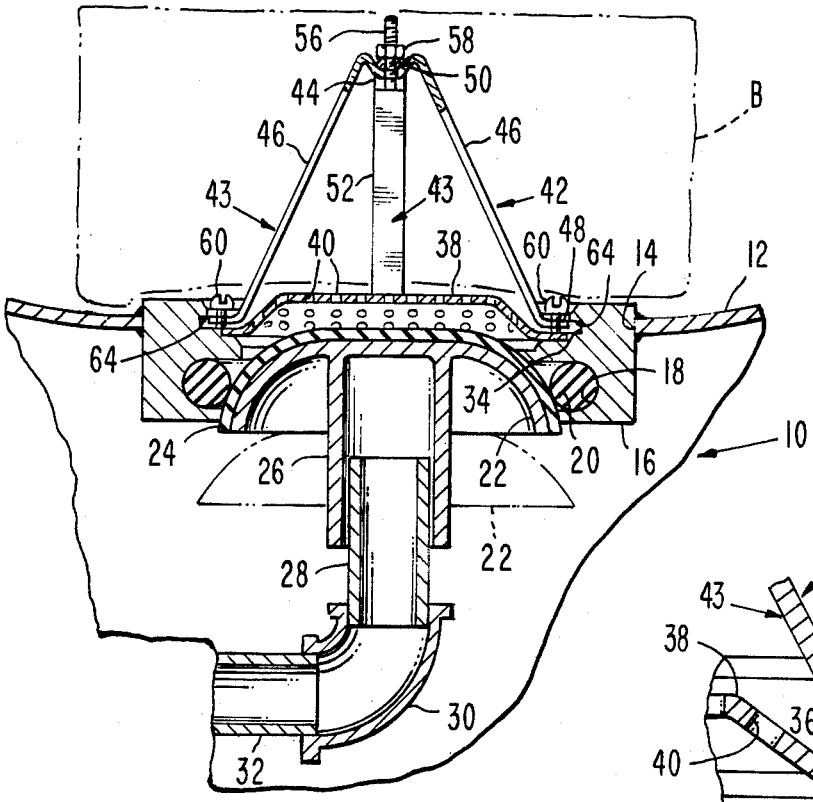
FIG. 2 is a vertical sectional view through the tank and through the bag opener and screen assembly, also showing the means for sealably closing the opening, taken substantially on line 2—2 of FIG. 1.

Normally, when the tank is de-pressurized, the plunger head gravitates to a position shown in dotted lines in FIG. 2. When, however, air under pressure is directed through tube 32, the air is directed straight upwardly against the underside of the plunger head, at the upper end of the stem 26, thereby forcing the plunger head against the O-ring 20. As a result, the tank is immediately sealed, so that continued introduction of air under pressure through the air inlet tube places the tank under steadily increasing pressure, until a predetermined, pressurized condition is reached. The tank is thus readied for operation, assuming of course that it has been previously charged with a selected quantity of abrasive media.

The construction so far described, in and of itself, is already known, that is, it is known to provide holders with O-ring grooves, adapted to receive O-rings against which a plunger head is sealably engageable in the manner described above.

In accordance with the present invention, however, the holder includes additional structural features, not found in conventional O-ring holders. In the present invention, the holder is provided, immediately above the O-ring groove, with a continuous, angular overhang 34 the top surface of which defines an upwardly facing, flat shoulder 36, on which the flange or peripheral portion 37 of a circular, screen 38 of inverted dished form is adapted to seat. Screen 38 has apertures of a selected size, to permit passage of the particulates needed for a particular blast-cleaning task.

It is also conventional to provide a screen supported by the holder, the screen being selected according to the particular abrasive media being used, so that large chunks that may be present in the bag will not fall through into the tank where they might tend to clog the associated exit ports or valves, not shown, used for discharge of the airborne stream of abrasive media from the tank into the cleaning hose or conduit.

In accordance with the invention there is provided a bag opening frame generally designated 42. In the illustrated example, this comprises two bars 43 of inverted V-shape, disposed in crossing relation perpendicularly to each other. One of the bars is formed with an upwardly facing seat 44, receiving the apex portion of the other bar.

The provision of the bars 43 defines, on each bar, a pair of downwardly diverging legs 46, terminating at their lower ends in outwardly directed, flat feet overlying the peripheral portion of the screen.

Each of the bars 43 is formed with a center portion, which defines the apex part of the inverted V-shape of the bar, the center portions being disposed in face-to-face contact at the location of the seat 44. The center portions 50 of the respective bars are formed with openings that are disposed in registration, to receive a bolt 56, on which is threaded a nut 58, whereby the bars are fixedly connected in crossed, perpendicular relation to define the upwardly pyramidal, open frame referred to previously herein.

As noted, the shank of the bolt may project upwardly to a slight extent, so as to facilitate initial puncturing of a bag B up-ended and dropped onto the frame.

It is important to note that the legs of the respective bars are formed as flat, wide elements, with the flat surfaces thereof faced upwardly, in facing relation to the end of the bag gravitating onto the frame. As a result, when the bag is dropped onto the frame, the great weight of the bag causes it to be punctured immediately upon the apex portion of the bag opening frame. Continued downward, gravitational movement of the bag causes the bag to be torn along the lengths of the respective legs, with the torn area being spread apart by the downwardly diverging legs until the bag fully comes to rest upon the top wall of the tank.

By reason of this arrangement, wherein the wide, flat faces of the legs are presented to the lower end of the bag, the tears in the bag caused by the legs are relatively wide, so as to facilitate the emptying of the bag contents onto the screen for passage into the tank through the fill opening.

In this way, all that is necessary is for one to lift a closed bag, and up-end it onto the top wall of the tank, for gravitation onto the bag opening frame. The frame immediately tears open the bag as it gravitates to the position shown in FIG. 2. The wide tears, along crossing lines defined by the perpendicularly related legs, facilitate the swift emptying of the contents of the bag into the tank. Accordingly, the down time of the system, resulting from the necessity of de-pressurizing the tank and refilling it with abrasive media, is held to a minimum.

Figure 3:
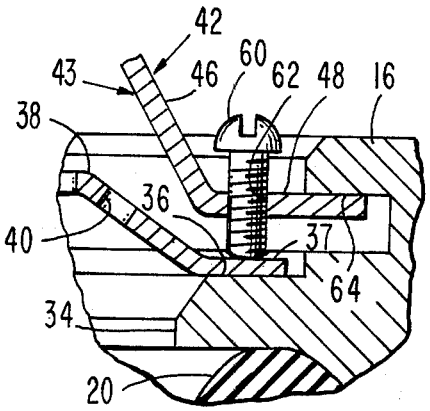
FIG. 3 is an enlarged, detailed sectional view on the same cutting plane as FIG. 2, showing the engagement of the bag opener frame and screen with the associated holder, portions being broken away.

To mount the screen and the bag opening frame upon the holder, screws 60 are engaged in threaded openings 62 formed in the feet of the several legs 52. Screws 60 bear against the peripheral portion of the screen, as clearly shown in FIG. 3.

Holder 16, in this regard, is formed with a downwardly facing shoulder 64, opposing shoulder 36 and spaced upwardly from the shoulder 36. The feet of the legs, and the peripheral portion of the screen, extend into the space between the opposed shoulders. As a result, when the screws 60 are rotated in one direction, they spread the feet and the peripheral portion of the screen apart, so as to cause them to bind tightly against the respective, opposed shoulders 36, 64. In this way, the frame and the screen are clamped to the holder, so as to be immovably positioned during the regular, normal operation of breaking open a bag and refilling the tank with abrasive media.

When, however, it is desired to remove the frame and the screen, it is necessary only that the screws be backed off slightly, as a result of which the tight engagement of the feet and the screen with the respective shoulders, is broken. The frame can be swiftly removed, along with the screen.

This is desirable, since in some instances it may be desired to use a screen having openings 40 of a different size, according to the particular kind of abrasive media that is being used in the blast cleaning system. It may also be desired to remove and possibly replace the opener frame. Indeed, during initial shipment of the blast cleaning system, the frame may be shipped in a disassembled condition, and assembled with the tank at the site at which the cleaning system is to be placed in operation.

To facilitate this, the legs are spring-tensioned so as to normally be urged into the space between the opposed shoulders. Whenever they are to be disengaged from the shoulders, with the screws 60 backed off, one need simply press the legs inwardly, so as to cause them to clear the shoulder 64, whereby to permit bodily removal of the entire opener frame. This, in turn, exposes the screen for removal if need be.

It is also important to note that the holder is so designed, in association with the screen and the opener frame 42, as to eliminate the need for modification of the O-ring-supporting portion of the holder, and the plunger head associated with the supported O-ring. Since the plunger head is normally of upwardly bulged form, the screen is in the form of an inverted dish, and is in spaced relation to the plunger head when the plunger head is in its sealing position. The screen projects upwardly into the lower part of the bag opener frame, so that a compact assembly is provided, in which no components of the opening means or screening means or sealing means interfere with one another during the normal discharge of their assigned functions.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. A device for breaking open a bag of particulate materials above the fill opening of an enclosure adapted for containing a quantity of said materials, for example the pressure tank of a blast cleaning system, comprising:

(a) a support structure mounted on said enclosure and extending about said opening;

(b) a plurality of legs extending from the support structure at locations angularly spaced thereabout and converging above said opening to form an upwardly tapered, open frame terminating in a point and adapted to break open a bag dropped thereon, for gravitation of the contents thereof through the fill opening;

(c) means for securing said legs to the support structure;

(d) a screen extending across the fill opening below the legs; and (e) means simultaneously, removably clamping both the screen and the several legs to the support structure.

2. A bag opening device as in claim 1 in which the support structure is formed with opposed, spaced shoulders, the legs having feet and the screen having its periphery extending into the space between the shoulders, said clamping means forcing said feet and periphery simultaneously against the respective shoulders.

3. A bag opening device as in claim 2 wherein the clamping means comprises a screw threadedly engaged in each of said feet and bearing against the periphery of the screen, whereby to spread apart said feet and the periphery of the screen when the screw is threadedly advanced toward the screen, thereby to bind the feet and the screen periphery against the respective shoulders.

4. A device for breaking open a bag of particulate materials above the fill opening of an enclosure, such as the pressure tank of a blast cleaning system, adapted for holding a quantity of said materials, comprising:

(a) an annular holder fixedly secured to said enclosure within said opening and having opposed, spaced shoulders facing inwardly of said opening;

(b) a screen extending across the opening and having a peripheral portion seating on one of said shoulders;

(c) a bag opening frame comprising a plurality of legs extending upwardly from the holder in converging relation and joined together at their point of convergence, said legs including outwardly directed feet extending into the space between said shoulders above the peripheral portion of the screen; and (d) means for spreading the feet and said peripheral portion apart to clampably engage the same against the respective shoulders.

5. A bag opening device as in claim 4 wherein said legs form a pyramidally shaped frame centered in respect to said screen and fill opening.

6. A bag opening device as in claim 5 wherein said frame comprises a pair of inverted V-shaped bars crossing and secured together at the apices of the V's.

7. A bag opening device as in claim 6 wherein the bars intersect at right angles to each other.

8. A bag opening device as in claim 4 wherein the spreading means comprises a screw threadedly engaged in each foot and bearing at one end against the peripheral portion of the screen so as to, when turned in one direction, spread the foot and said peripheral portion apart into tight frictional engagement with the respective shoulders and, when turned in the opposite direction, disengage the foot and the peripheral portion of the screen from the shoulders.

9. A bag opening device as in claim 4 wherein the holder has a continuous groove facing inwardly of said opening below said shoulders, a resilient sealing ring engaged in said groove, and an upwardly bulged plunger head normally sealably engaged against the ring to close said opening, said screen being of inverted dished form and extending into the area bounded by said frame so as to extend clear of the plunger head.

* * * * *